US006179194B1

(12) United States Patent
Morton

(10) Patent No.: US 6,179,194 B1
(45) Date of Patent: Jan. 30, 2001

(54) CARTRIDGE FED STAPLER

(76) Inventor: Mack R. Morton, 25 Scott Dr., Churchville, PA (US) 18966

( * ) Notice: Under 35 U.S.C. 154(b), the term of this patent shall be extended for 0 days.

(21) Appl. No.: 09/426,157

(22) Filed: Oct. 22, 1999

(51) Int. Cl.[7] ..... B25C 5/00
(52) U.S. Cl. ..... 227/133; 227/147; 227/120
(58) Field of Search ..... 227/133, 109, 227/147, 120

(56) References Cited

U.S. PATENT DOCUMENTS

| | | | | |
|---|---|---|---|---|
| 1,344,715 | * | 6/1920 | Pope | 227/133 |
| 2,279,624 | * | 4/1942 | La Place | 227/133 |
| 2,332,257 | * | 10/1943 | Polzer | 227/109 |
| 2,355,807 | * | 8/1944 | La Place | 227/133 |
| 2,463,579 | * | 3/1949 | Vail | 227/133 |
| 3,007,171 | * | 11/1961 | Critchley | 227/109 |
| 5,975,401 | * | 11/1999 | Fealey | 227/147 |

* cited by examiner

*Primary Examiner*—Scott A. Smith

(57) ABSTRACT

A cartridge fed stapler that is fed with a cartridge containing a plurality of staples. The cartridge fed stapler includes a head and a handle. The head is for holding a staple driving mechanism and is hollow. The head has a front wall, a back wall, a top wall, a bottom wall and a pair of opposing side walls. The back wall of the head has a bore therein and is adapted to couple to the handle. The staple driving mechanism is adjacent to the front wall of the head. The handle has a proximal end and a distal end. The proximal end of the handle is coupled to the bore in the back wall of the housing. A cartridge for holding a plurality of rows of staples is adapted to be removably placed within the staple hammer between the distal end of the hammer and the driving mechanism. At least one spring is located within the handle and is adapted to urge the rows of staples toward the staple driving mechanism.

10 Claims, 5 Drawing Sheets

52
67
50
4
60
61
4
59
51

5
54
58
56
57
5

59
55
62
65
53
64
63

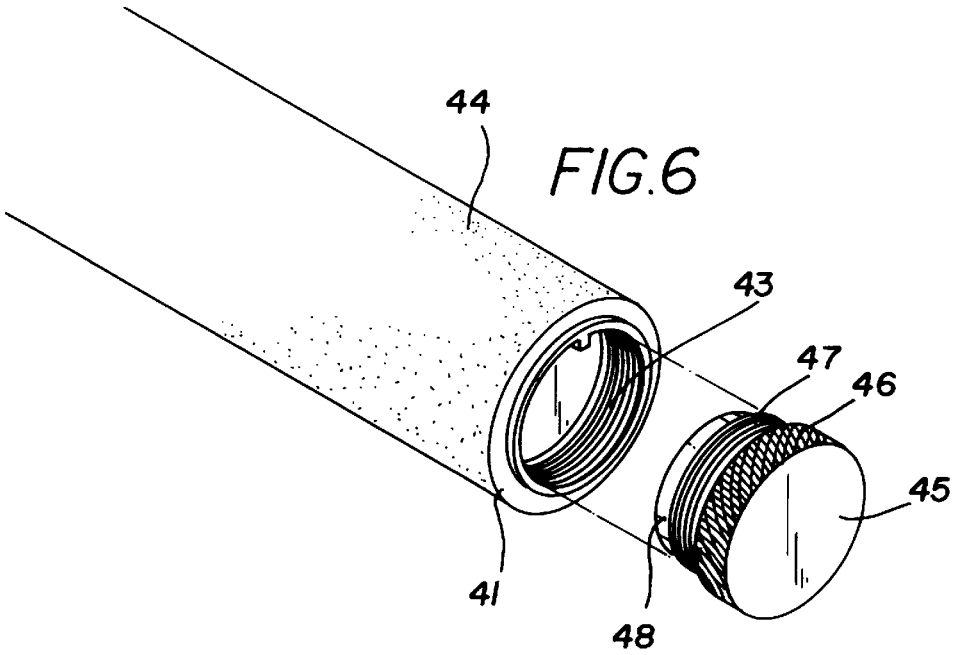
FIG.6
FIG.7
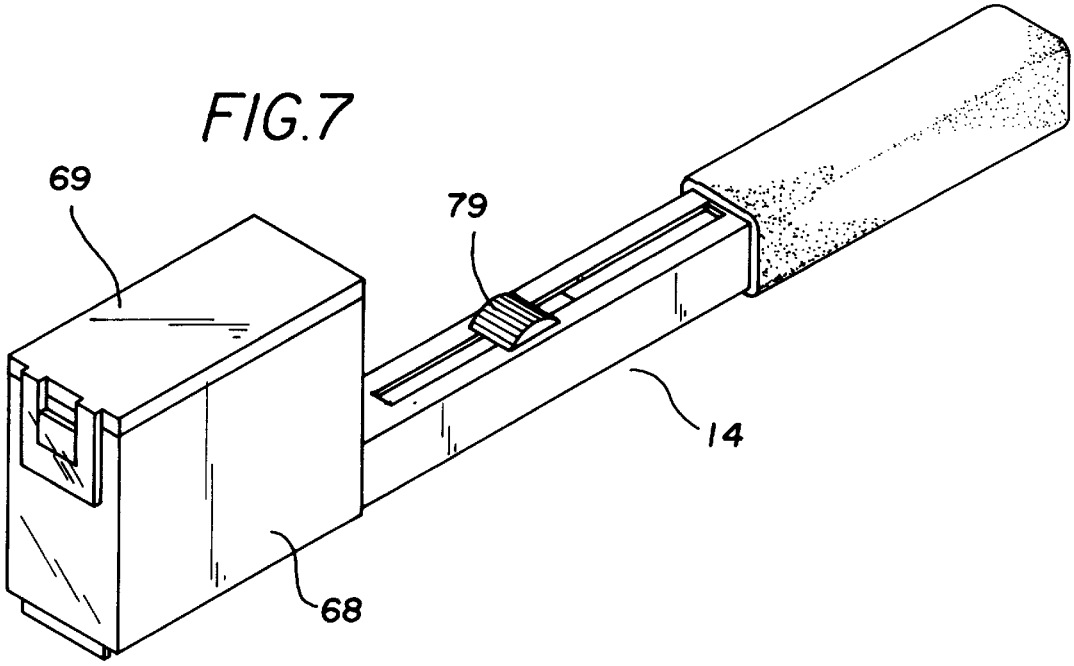

CARTRIDGE FED STAPLER

BACKGROUND OF THE INVENTION

1. Field of the Invention

The present invention relates to staplers and more particularly pertains to a new cartridge fed stapler that is fed with a cartridge containing a plurality of staples.

2. Description of the Prior Art

The use of staplers is known in the prior art. More specifically, staplers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 25,896,210; U.S. Pat. No. 2,757,378; U.S. Pat. No. 3,113,317; U.S. Pat. No. 2,524,061; U.S. Pat. No. 2,537,601; and U.S. Pat. Des. No. 288,404.

While these devices fulfill their respective, particular objectives and requirements, the aforementioned patents do not disclose a new cartridge fed stapler. The inventive device includes a head and a handle. The head is for holding a staple driving mechanism and is hollow. The head has a front wall, a back wall, a top wall, a bottom wall and a pair of opposing side walls. The back wall of the head has a bore therein and is adapted to couple to the handle. The staple driving mechanism is adjacent to the front wall of the head. The handle has a proximal end and a distal end. The proximal end of the handle is coupled to the bore in the back wall of the housing. A cartridge for holding a plurality of rows of staples is adapted to be removably placed within the staple hammer between the distal end of the hammer and the driving mechanism. At least one spring is located within the handle and is adapted to urge the rows of staples toward the staple driving mechanism.

In these respects, the cartridge fed stapler according to the present invention substantially departs from the conventional concepts and designs of the prior art, and in so doing provides an apparatus primarily developed for the purpose of feeding staples into a head of a stapler via a cartridge containing many rows of staples.

SUMMARY OF THE INVENTION

In view of the foregoing disadvantages inherent in the known types of staplers now present in the prior art, the present invention provides a new cartridge fed stapler construction wherein the same can be utilized for containing a cartridge containing a plurality of rows of staples.

The general purpose of the present invention, which will be described subsequently in greater detail, is to provide a new cartridge fed stapler apparatus and method which has many of the advantages of the staplers mentioned heretofore and many novel features that result in a new cartridge fed stapler which is not anticipated, rendered obvious, suggested, or even implied by any of the prior art staplers, either alone or in any combination thereof.

To attain this, the present invention generally comprises a head and a handle. The head is for holding a staple driving mechanism and is hollow. The head has a front wall, a back wall, a top wall, a bottom wall and a pair of opposing side walls. The back wall of the head has a bore therein and is adapted to couple to the handle. The staple driving mechanism is adjacent to the front wall of the head. The handle has a proximal end and a distal end. The proximal end of the handle is coupled to the bore in the back wall of the housing. A cartridge for holding a plurality of rows of staples is adapted to be removably placed within the staple hammer between the distal end of the hammer and the driving mechanism. At least one spring is located within the handle and is adapted to urge the rows of staples toward the staple driving mechanism.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cartridge fed stapler apparatus and method which has many of the advantages of the staplers mentioned heretofore and many novel features that result in a new cartridge fed stapler which is not anticipated, rendered obvious, suggested, or even implied by any of the prior art staplers, either alone or in any combination thereof.

It is another object of the present invention to provide a new cartridge fed stapler which may be easily and efficiently manufactured and marketed.

It is a further object of the present invention to provide a new cartridge fed stapler which is of a durable and reliable construction.

An even further object of the present invention is to provide a new cartridge fed stapler which is susceptible of a low cost of manufacture with regard to both materials and labor, and which accordingly is then susceptible of low prices of sale to the consuming public, thereby making such cartridge fed stapler economically available to the buying public.

Still yet another object of the present invention is to provide a new cartridge fed stapler which provides in the apparatuses and methods of the prior art some of the advantages thereof, while simultaneously overcoming some of the disadvantages normally associated therewith.

Still another object of the present invention is to provide a new cartridge fed stapler that is fed with a cartridge containing a plurality of staples.

Yet another object of the present invention is to provide a new cartridge fed stapler which includes a head and a handle. The head is for holding a staple driving mechanism and is hollow. The head has a front wall, a back wall, a top wall, a bottom wall and a pair of opposing side walls. The back wall of the head has a bore therein and is adapted to couple to the handle. The staple driving mechanism is adjacent to the front wall of the head. The handle has a proximal end and a distal end. The proximal end of the handle is coupled to the bore in the back wall of the housing. A cartridge for holding a plurality of rows of staples is adapted to be removably placed within the staple hammer between the distal end of the hammer and the driving mechanism. At least one spring is located within the handle and is adapted to urge the rows of staples toward the staple driving mechanism.

Still yet another object of the present invention is to provide a new cartridge fed stapler that removes the difficulty of refilling a standard stapler when the user is in an awkward position. Staples used in hammer staples come loose and are time consuming and awkward to load, especially in dangerous work areas. A cartridge solves that problem by being pre-loaded with a plurality of rows of staples.

Even still another object of the present invention is to provide a new cartridge fed stapler that can be fed faster and thus will increase productivity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic perspective view of the handle of the present invention.

FIG. 7 is a schematic perspective view of a second embodiment of the present invention.

DESCRIPTION OF THE PREFERRED EMBODIMENT

Figure 1:
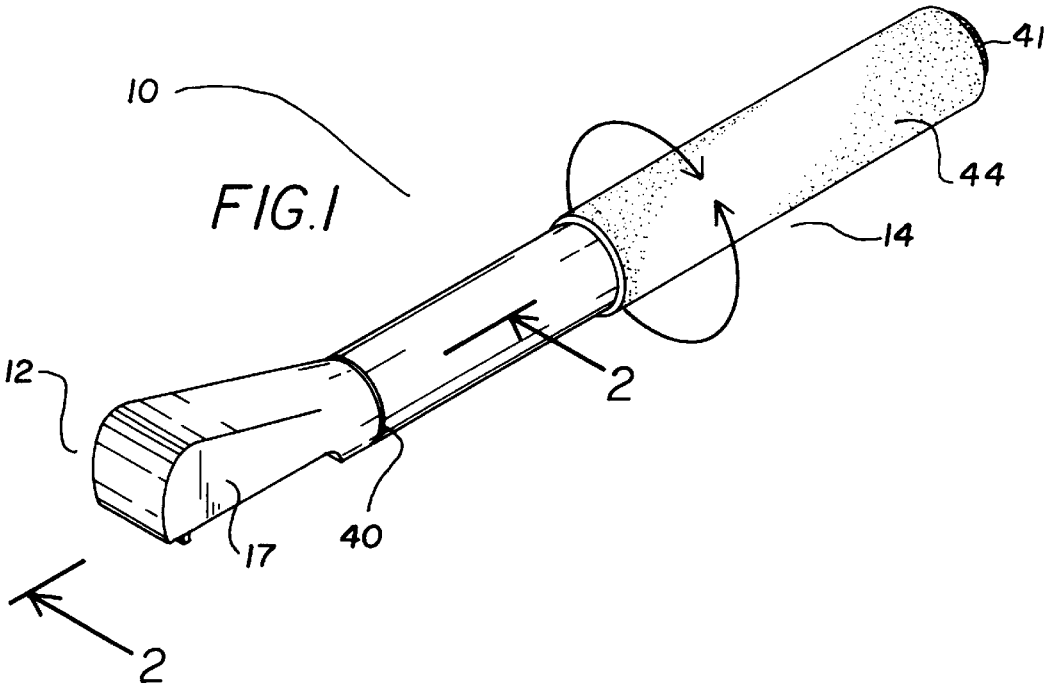
FIG. 1 is a schematic perspective view of a new cartridge fed stapler according to the present invention.
Figure 2:
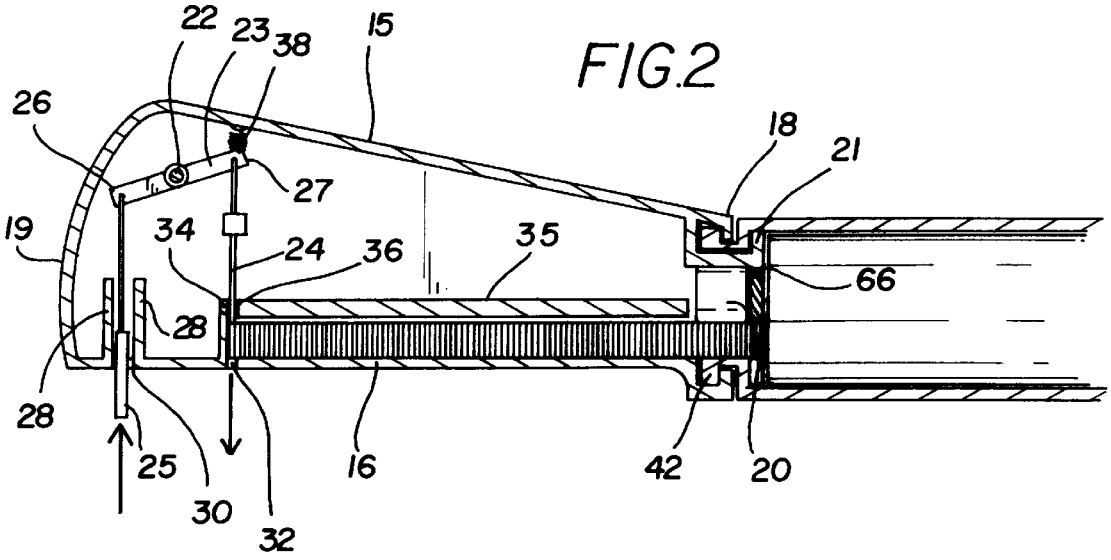
FIG. 2 is a schematic cross-sectional view along line 2—2 of the present invention.
Figure 3:
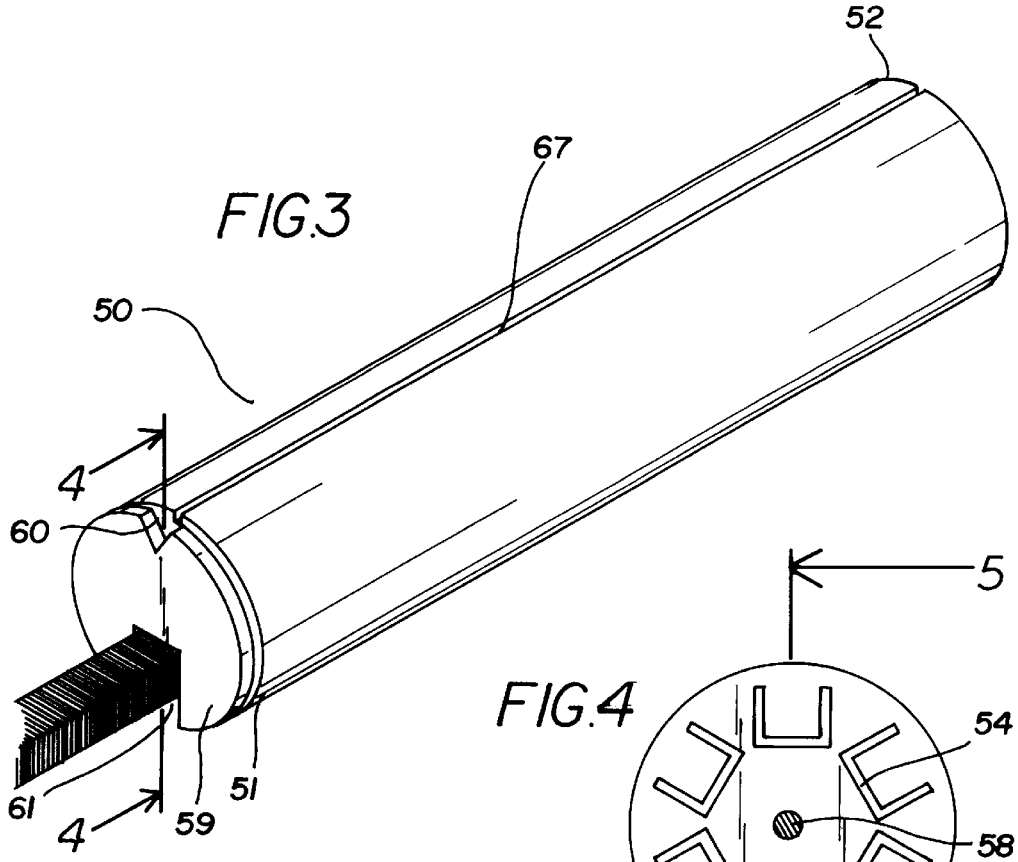
FIG. 3 is a schematic perspective view of the cartridge of the present invention.
Figure 4:
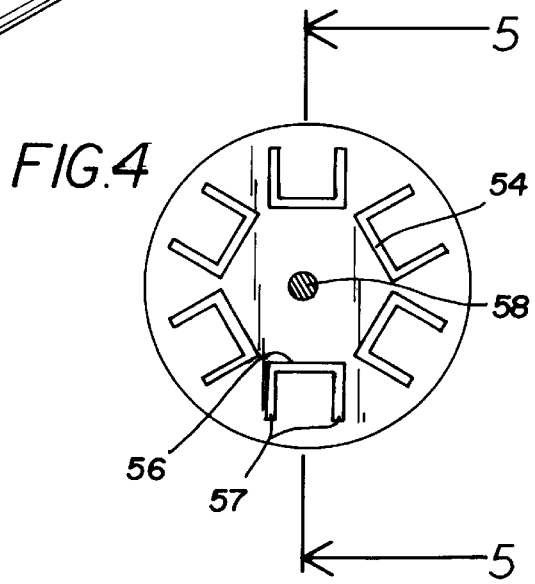
FIG. 4 is a schematic cross-sectional view taken along line 4—4 of the present invention.
Figure 5:
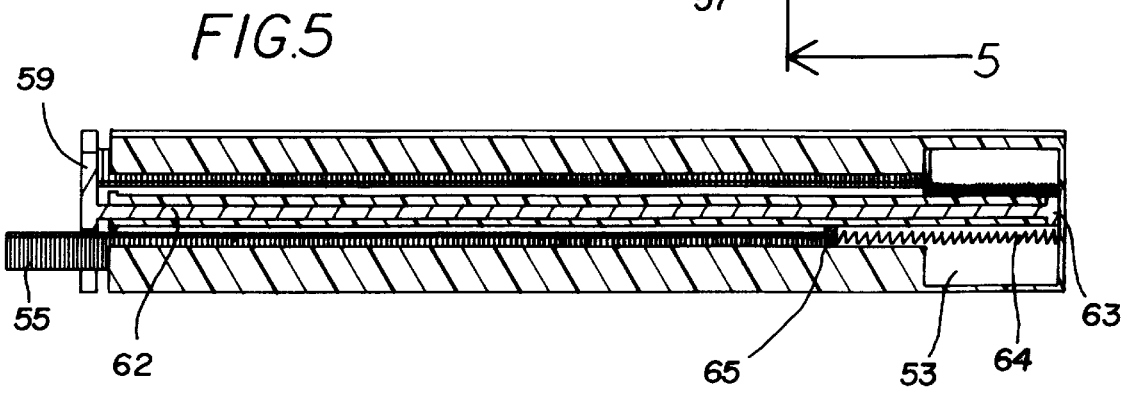
FIG. 5 is a schematic cross-sectional view taken along line 5—5 of the present invention.
Figure 8:
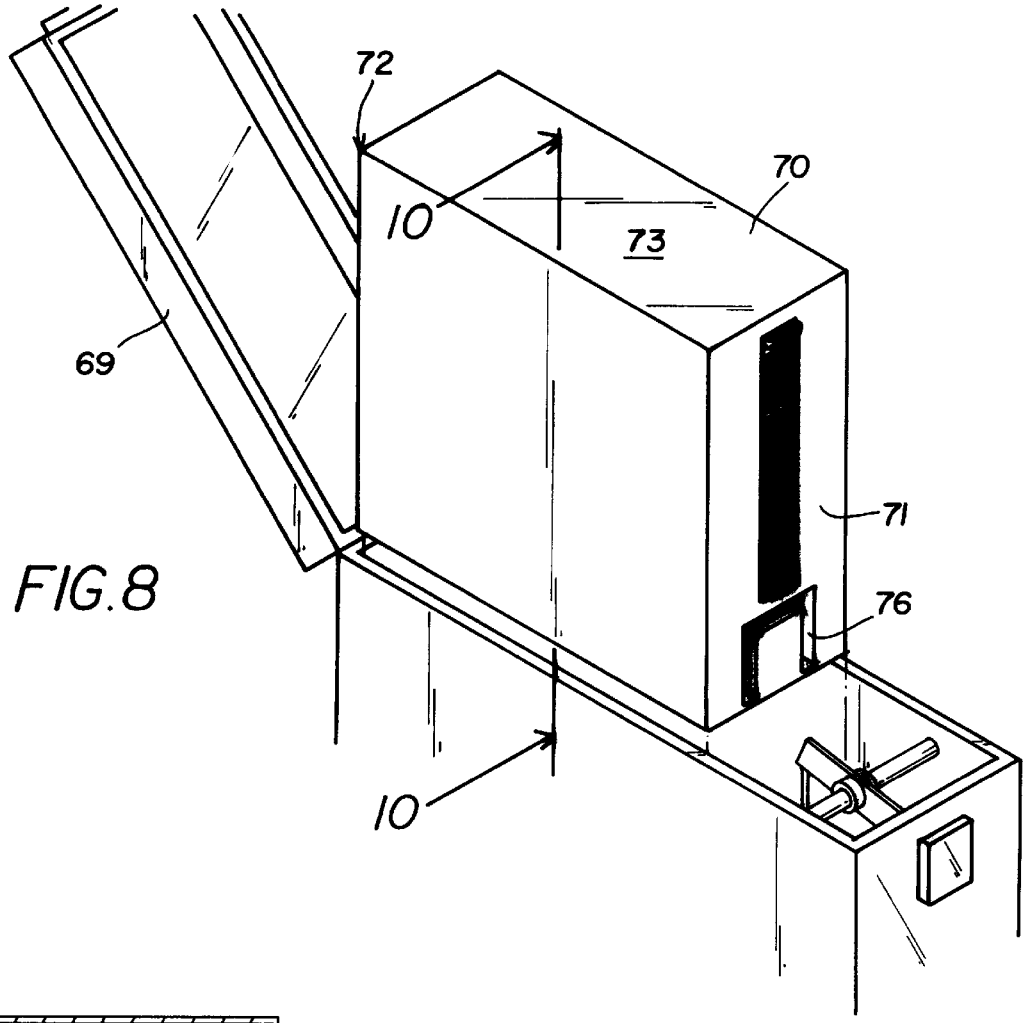
FIG. 8 is a schematic perspective view of the cartridge of the second embodiment of the present invention.
Figure 9:
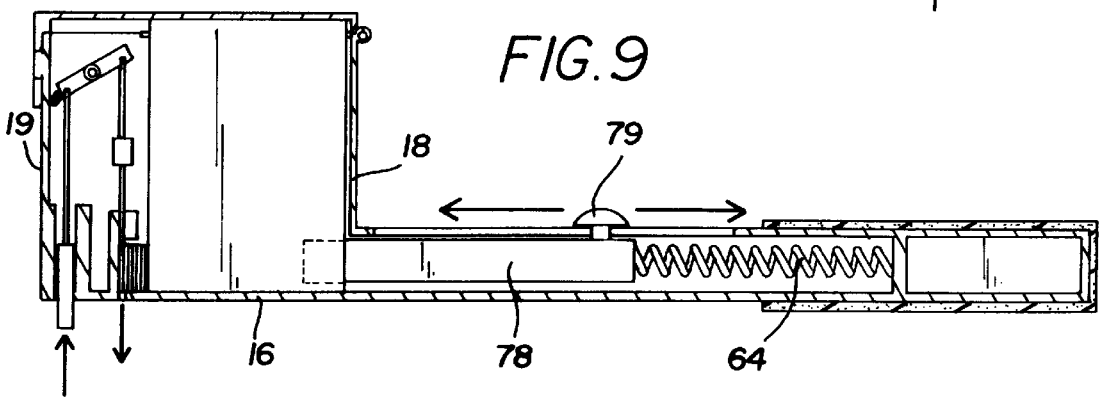
FIG. 9 is a schematic cross-sectional view second embodiment of the present invention.
Figure 10:
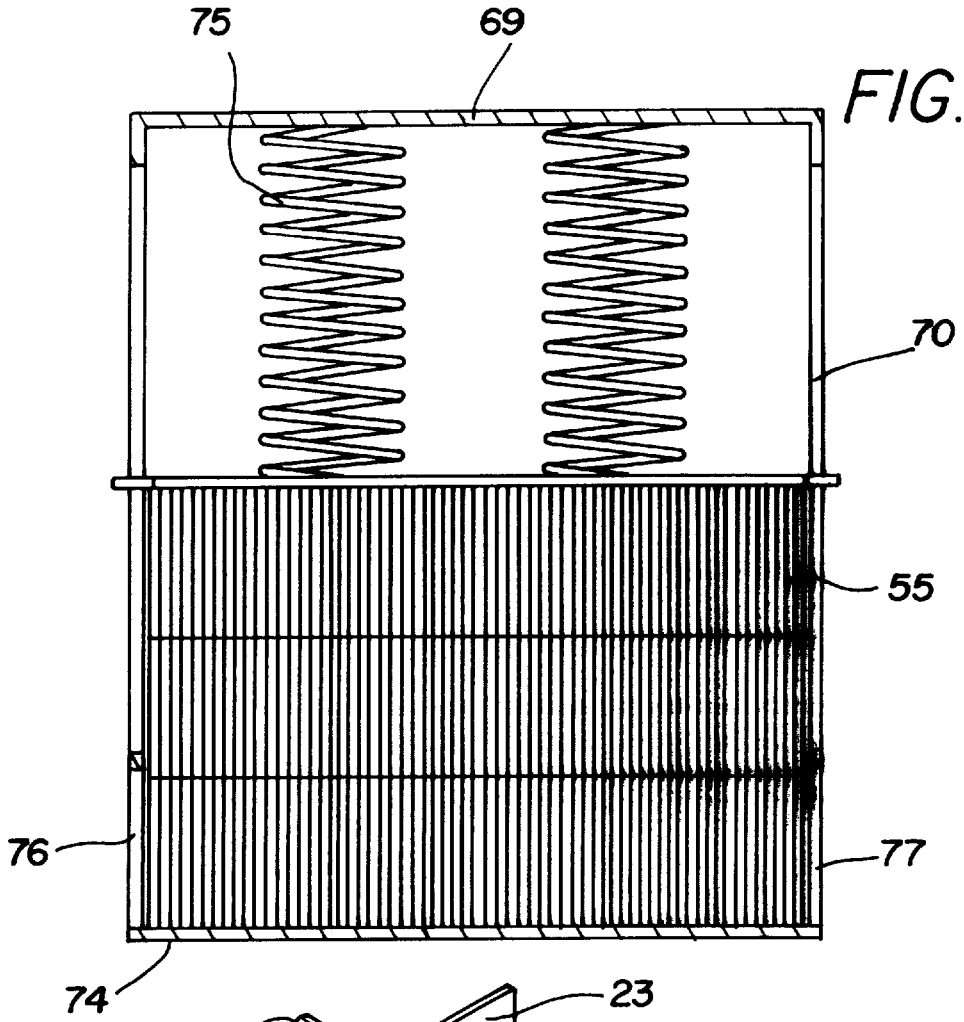
FIG. 10 is a schematic cross-sectional view taken along line 10—10 of the cartridge of the second embodiment of the present invention.
Figure 11:
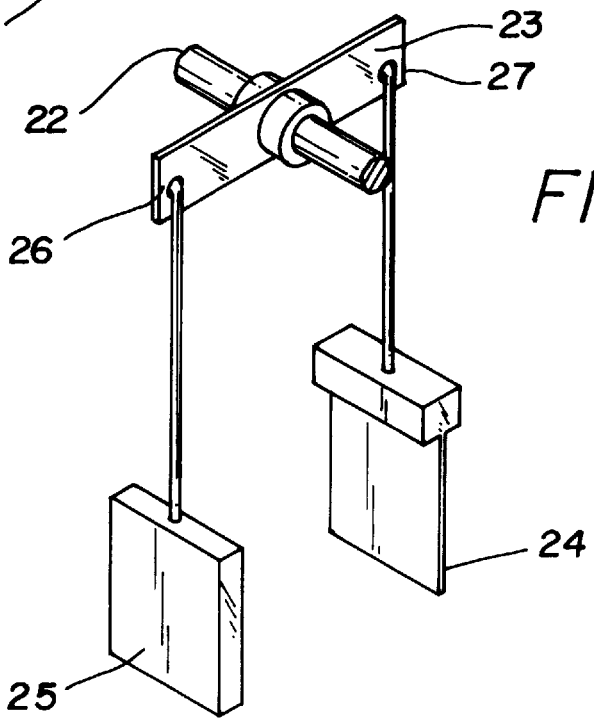
FIG. 11 is a schematic perspective view of the staple driving mechanism of the present invention.

With reference now to the drawings, and in particular to FIGS. 1 through 11 thereof, a new cartridge fed stapler embodying the principles and concepts of the present invention and generally designated by the reference numeral 10 will be described.

As best illustrated in FIGS. 1 through 11 the cartridge fed stapler 10 generally comprises a head 12 and a handle 14. The head 12 is for holding a staple driving mechanism and has a generally hollow interior. The head is elongate and has a top wall 15, a bottom wall 16, two opposing side walls 17, a back wall 18 and a front wall 19. The back wall 18 has a generally circular bore 20 therein, An edge of the bore defines a shoulder 21 which is adapted to receive a portion of the handle 14. Preferably, the front wall 19 has a height greater than the back wall 18 such that an obtuse angle generally between 90 degrees and 145 degrees is formed by the juncture of the top wall and the back wall. The head has a longitudinal axis defined by a line extending from the front wall to the back wall.

A pivot shaft 22 for rotating a connecting member 23 is mounted to each of the opposing side walls 17 of the head 12. The pivot shaft 22 is orientated perpendicularly to the longitudinal axis of the head. The pivot shaft 22 is located approximately adjacent to the front wall 19 and the top wall 15.

A connecting member 23 connects a driving plate 24 and a striking hammer 25 to the pivot shaft. The connecting member 23 is rotatably coupled to the pivot shaft 22. The connecting member has a longitudinal axis generally perpendicular to the connecting member, wherein the pivot shaft is generally located at a longitudinal midpoint of the connecting member. The connecting member 23 has a first end 26 and a second end 27, wherein the first end is substantially adjacent to the front wall 19 of the head.

A striking hammer 25 for striking a surface when the head is moved toward the surface is rotatably coupled to the first end 26 of the connecting member 23. The striking hammer extends away from the connecting member toward the bottom wall 16. Preferably, the striking hammer is generally rectangular and generally extends from one of the opposing walls 17 to another one of the opposing walls such that the striking hammer has a longitudinal axis generally perpendicular to the longitudinal axis of the housing. The striking hammer is guided by two spaced walls 28 which extend from the bottom wall 16 toward the top wall 15. The striking hammer extends through a first aperture 30 in the bottom wall. The first aperture is located between the spaced walls 28.

A second aperture 32 is in the bottom wall 16 for delivery of a staple. The second aperture is generally between the first aperture 28 and the back wall 18.

A driving plate 24 drives staples into the surface being struck through the second aperture 32. The driving plate is coupled to the second end 27 of the coupling member 23 and extends from the coupling member toward the bottom wall 16.

A first staple guide wall 34 is located adjacent to the second aperture 32 such that the second aperture 32 is between the first staple guide wall 34 and the bore in the back wall 20. The first staple guide wall is mounted on the bottom wall 16 and extends toward the top wall 15 generally perpendicular to the longitudinal axis of the housing.

A second staple guide wall 35 is oriented generally perpendicular to the first staple guide wall 34. The second staple guide wall is fixedly mounted to each of the opposing walls 17 of the head. The second staple guide wall extends between the bore 20 in the back wall of the head and the first staple guide wall 34. A first end 36 of the second staple guide 34 wall is substantially adjacent to the first staple guide wall and defines a space therebetween adapted for receiving the driving plate 24. The second staple guide wall is spaced a distance from the bottom wall 16 of the head approximately equal to a height of a staple.

A recoil spring 38 pulls the second end 27 of the connecting member toward the top wall 15 of the head. The recoil spring is coupled to the second end 27 of the connecting member 23 and an interior surface of the top wall 15. The recoil spring 38 urges the second end 37 of the connecting member toward the top wall 15 such that the driving plate 24 has an end situated in the space between the first 34 and the second 35 staple guides to define a resting position of the driving hammer 24. The recoil spring 38 biases the first end 26 of the connecting member towards the bottom wall 16 of the head 12 such that the striking hammer 25 extends to an exterior of the head through the first aperture 30 to further define the resting position. The end of the striking hammer being located substantially adjacent to the first aperture 30 defines an execution position. The second end 26 of the connecting member 23 is adapted to drive the end of the driving plate 24 to a point substantially adjacent to an exterior surface of the bottom wall 16.

The handle 14 is a substantially cylindrical cartridge housing for holding a cartridge. The housing has a proximal end 40 and a distal end 41. The proximal end 40 of the housing has a lip 42 thereon adapted for coupling to the shoulder 21 of the head 12 and is rotatably coupled to the head 12. The distal end 41 of the housing has an interior surface having threads 43 thereon adapted to receive a cap. The distal end 41 of the housing has an exterior surface having padding thereon 44.

A cap 45 for securing a cartridge in the housing is adapted to fit in the distal end 41 of the housing. The cap has a top portion 46, a middle portion 47 and an end portion 48. A surface of the top portion of the cap is knurled 46. A surface of the middle portion 47 of the cap has threads thereon adapted for coupling to the threads 43 in the housing. The end portion 48 of the cap extends into an interior of the housing when the cap 45 is screwed into the housing.

Next will be described the preferred cartridge for holding a plurality of rows of staples. The cartridge 50 has a proximal end 51 and a distal end 52, is generally cylindrical, and has seven wells therein. All of the wells extend along a longitudinal length of the cartridge between the proximal end of the cartridge and a compartment 53 within the cartridge adjacent to the distal end 52 of the cartridge. A first, second, third, fourth, fifth and sixth of the wells each has a U-shape 54 in a plane transverse to the longitudinal length of the cartridge 50. Each of the U-shaped wells 54 is adapted for receiving a row of staples 55 such that each of the U-shaped wells has a substantially linear top portion 56 and two side portions 57 extending away from the top portion. The side portions 57 are oriented substantially perpendicularly to the top portion 56, and each of the sides of the U-shaped wells extend toward an outer surface of the cartridge 50. The seventh well 58 is generally circular and extends through the cartridge along a generally longitudinal central axis of the cartridge 50.

A retaining disc 59 for retaining staples is in the cartridge and is adjacent to the proximal end 51 of the cartridge. The retaining disc is generally circular having two diametrically opposing peripheral apertures therein. Each of the apertures extends into the retaining disc from and edge of the retaining disc. A first of the apertures 60 is V-shaped such that a pointed portion of the first aperture is directed toward a center point of the retaining disc 59. A second of the apertures 61 is generally rectangular. The second aperture is adapted to allow exposure of only one of the U-shaped wells 54 in the cartridge. A shaft 62 for rotatably coupling the retaining disc 59 to the cartridge 50 is connected to a central location on the retaining disc. The shaft 62 extends through the seventh well 58 in the cartridge between the distal end 52 and the proximal end 51 of the cartridge. The shaft has a distal end extending out of the seventh well. The distal end of the shaft has a knob 63 thereon for holding the retaining disc 59 adjacent to the proximal end 51 of the cartridge 50. The knob 63 is disc shaped and has a diameter greater than a diameter of the seventh well 58 of the cartridge.

A compartment 53 within the distal end of the cartridge holds springs 64 to urge staples toward the proximal end 51 of the cartridge. The compartment has at least one spring for every U-shaped well 54 in the cartridge. The springs have a first end affixed to the distal end 52 of the cartridge. Preferably, the springs have a second end having a pressure plate 65 affixed thereto for pushing staples 55 through the U-shaped wells 54.

The cartridge is placed in the housing such that the retaining disc 59 is adjacent to the back wall 18 of the head 12. The back wall of the head has a pin 66 extending therefrom for insertion into the V-shaped aperture 60 in the retaining disc. Preferably, the cartridge has a ridge on 67 its surface for alignment with a notch, not shown, on the inner surface of the housing. The notch allows for easier rotation of the cartridge for exposing other rows of staples. The cap 45 is placed on the cartridge such that the end of the cap 48 is biased against the distal end 52 of the cartridge. The cartridge is turned such that the second aperture 61 in the disc 50 exposes one of the first through sixth wells causing the spring 54 to urge the row of staples through the second aperture 61 of the disc and into the head 12 adjacent to the first staple guide wall 34.

In a second embodiment as depicted in FIGS. 7–10 the head 68 is generally rectangular, wherein the top wall 69 of the head is removably coupled to the head. The cartridge 70 is also generally rectangular. The cartridge has dimensions so as to fit within the head 68 such that the cartridge is between the back wall and the staple driving mechanism. The cartridge is hollow and has a plurality of rows of staples 55 stacked therein. The cartridge has a facing wall 71 and a rear wall 72 such that the rear wall 72 is adjacent to the back wall 18 of the head. The cartridge has a top side 73 and a bottom side 74. The cartridge has at least one spring 75 therein mounted to an interior surface of the top side 73 of the cartridge. The spring urges the staples away from the top side 73 toward the bottom side 74 of the cartridge. The cartridge has a first bore 76 therein located in the facing wall generally adjacent to the bottom side. The cartridge has a second bore 77 therein located in the rear wall generally adjacent to the bottom side 74 of the cartridge.

The handle of the second embodiment is generally hollow. The handle has a push bar 78 therein adapted to fit through the second bore of the cartridge. The push bar is located between a spring 64 in the handle and the cartridge 70 such that the push bar is biased against the staples 50 within the cartridge. The push bar has a column 79 thereon extending through a slot in the handle. As the user uses a row of staples, the push bar 78 is pulled back to allow another row of staples 50 to fall against the bottom side of the cartridge 74. The push bar 78 is then released to bias it against the row of staples sending the staples against the driving mechanism.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A staple hammer for driving staples into a surface, said staple hammer comprising:

a head and a handle;

said head being for holding a staple driving mechanism, said head being hollow, said head having a front wall, a back wall, a top wall, a bottom wall and a pair of opposing side walls, wherein said back wall of said head having a bore therein being adapted to couple to said handle, said staple driving mechanism being generally adjacent to said front wall of said head;

said handle having a proximal end and a distal end, said proximal end of said handle being coupled to said bore in said back wall of said housing;

a cartridge for holding a plurality of rows of staples, said cartridge being adapted to be removably placed within said staple hammer between said distal end of said hammer and said driving mechanism, wherein at least one spring is located within said handle, said spring being adapted to urge the rows of staples toward said staple driving mechanism;

said head being generally rectangular, wherein said top wall of said head being removably coupled to said head; and said cartridge being generally rectangular, said cartridge having dimensions so as to fit within said head such that said cartridge is between said back wall and said staple driving mechanism, said cartridge being hollow, said cartridge having a plurality of rows of staples stacked therein, said cartridge having a facing wall and a rear wall such that said rear wall is adjacent to said back wall of said head, said cartridge having a top side and a bottom side, said cartridge having at least one spring therein, said spring being mounted to an interior surface of said top side of said cartridge, said spring urging said staples away from said top side toward said bottom side of said cartridge, said cartridge having a first bore therein, said first bore being located in said facing wall generally adjacent to said bottom side, said cartridge having a second bore therein, said second bore being located in said rear wall generally adjacent to said bottom side of said cartridge.

2. The staple hammer for driving staples into a surface as in claim 1, wherein said handle is generally hollow, said handle having a push bar therein, said push bar being adapted to fit through said second bore of said cartridge, said push bar being located between said spring in said handle and said cartridge such that said push bar is biased against said staples within said cartridge, said push bar having a column thereon extending through a slot in said handle.

3. The staple hammer for driving staples into a surface as in claim 1, wherein said staple driving mechanism comprises:

a pivot shaft for rotating a connecting member, said pivot shaft being mounted to each of said opposing side walls of said head, said pivot shaft being orientated perpendicularly to a longitudinal axis of said head, said longitudinal axis defined by a line extending from said front wall of said head to said back wall of said head, said pivot shaft being located approximately adjacent to said front wall and said top wall;

a connecting member for connecting a driving plate and a striking hammer to said pivot shaft, said connecting member being rotatably coupled to said pivot shaft, said connecting member having a longitudinal axis generally perpendicular to said connecting member, wherein said pivot shaft is generally located at a longitudinal midpoint of said connecting member, said connecting member having a first end and a second end, wherein said first end is substantially adjacent to said front wall of said head;

a striking hammer for striking a surface when said head is moved toward said surface, said striking hammer being rotatably coupled to said first end of said connecting member, said striking hammer extending away from said connecting member toward said bottom wall, said striking hammer extending through a first aperture in said bottom wall;

a second aperture in said bottom wall for delivery of a staple, said second aperture being generally between said first aperture and said back wall;

a driving plate for driving staples into said surface through said second aperture, said driving plate being coupled to said second end of said coupling member, said driving plate extending from said coupling member toward said bottom wall; and a recoil spring for pulling said second end of said connecting member toward said top wall of said head.

4. The staple hammer for driving staples into a surface as in claim 3, further comprising a first staple guide wall, wherein said first staple guide wall is located adjacent to said second aperture such that said aperture is between said first staple guide wall and said bore in said back wall.

5. The staple hammer for driving staples into a surface as in claim 1, further comprising:

a cartridge for holding a plurality of rows of staples;

said handle forming a hollow cartridge housing for holding said cartridge, said housing having a proximal end and a distal end, said proximal end of said housing being rotatably coupled to said head;

a cap for securing said cartridge in said housing, said cap being adapted to fit in said distal end of said housing;

said cartridge having a proximal end and a distal end, said cartridge having a shape generally identical a shape of said housing, said cartridge having a plurality of wells therein, all of said wells extending along a longitudinal length of said cartridge between said proximal end of said cartridge and a compartment within said cartridge adjacent to said distal end of said cartridge, said wells each having a U-shape in a plane transverse to the longitudinal length of said cartridge, each of said U-shaped wells being adapted for receiving a row of staples such that each of said U-shaped wells has a substantially linear top portion and two side portions extending away from said top portion, said side portions being oriented substantially perpendicularly to said top portion, each of said sides of said U-shaped wells extending toward an outer surface of said cartridge; and a compartment within said distal end of said cartridge for holding springs to urge staples toward said proximal end of said cartridge.

6. A staple hammer for driving staples into a surface, said staple hammer comprising:

a head and a handle;

said head being for holding a staple driving mechanism, said head having a back wall and a front wall;

said handle being a substantially cylindrical cartridge housing for holding a cartridge, said housing having a proximal end and a distal end, said proximal end of said housing being rotatably coupled to said back wall of said head;

a cap for securing a cartridge in said housing, said cap being adapted to fit in said distal end of said housing;

a cartridge for holding a plurality of rows of staples, said cartridge having a proximal end and a distal end, said cartridge being generally cylindrical, said cartridge having seven wells therein, all of said wells extending along a longitudinal length of said cartridge between said proximal end of said cartridge and a compartment within said cartridge adjacent to said distal end of said cartridge, a first, second, third, fourth, fifth and sixth of said wells each having a U-shape in a plane transverse to the longitudinal length of said cartridge, each of said U-shaped wells being adapted for receiving a row of staples such that each of said U-shaped wells has a substantially linear top portion and two side portions extending away from said top portion, said side portions being oriented substantially perpendicularly to said top portion, each of said sides of said U-shaped wells extending toward an outer surface of said cartridge, said seventh well being generally circular and extending through said cartridge along a generally longitudinal central axis of said cartridge;

a retaining disc for retaining staples in said cartridge, said retaining disc being adjacent to said proximal end of said cartridge, said retaining disc being generally circular, said retaining disc having two diametrically opposing peripheral apertures therein, wherein each of said apertures extends into said retaining disc from and edge of said retaining disc, a first of said apertures being V-shaped such that a pointed portion of said first aperture is directed toward a center point of said retaining disc, a second of said apertures being generally rectangular, said second aperture being adapted to allow exposure of only one of said U-shaped wells in said cartridge;

a shaft for rotatably coupling said retaining disc to said cartridge, said shaft being connected to a central location on said retaining disc, said shaft extending through said seventh well in said cartridge between said distal end and said proximal end of said cartridge, said shaft having a distal end extending out of said seventh well, wherein said distal end of said shaft has a knob thereon for holding said retaining disc adjacent to said proximal end of said cartridge, said knob being disc shaped and having a diameter greater than a diameter of said seventh well of said cartridge;

a compartment within said distal end of said cartridge for holding springs to urge staples toward said proximal end of said cartridge, said compartment having at least one spring for every U-shaped well in said cartridge, said springs having a first end affixed to said distal end of said cartridge, said springs having a second end having a pressure plate affixed thereto for pushing staples through said U-shaped wells;

wherein said cartridge is placed in said housing such that said retaining disc is adjacent to said back wall of said head, said back wall of said head having a pin extending therefrom for insertion into said V-shaped aperture in said retaining disc;

wherein said cap is placed on said distal end of housing such that said end of said cap is biased against said distal end of said cartridge; and wherein said cartridge is turned such that said second aperture in said disc exposes one of said first through sixth wells, said springs urging the staples through said second aperture and into said head adjacent to said first staple guide wall in said head.

7. A staple hammer for driving staples into a surface, said staple hammer comprising:

a head and a handle;

said head being for holding a staple driving mechanism, said head having a generally hollow interior, said head being elongate and having a top wall, a bottom wall, two opposing side walls, a back wall and a front wall, said back wall having a generally circular bore therein, wherein an edge of the bore defines a shoulder, said shoulder being adapted to receive a portion of said handle, said front wall having a height greater than said back wall such that an obtuse angle generally between 90 degrees and 145 degrees is formed by the juncture of said top wall and said back wall, said head having a longitudinal axis defined by a line extending from said front wall to said back wall;

a pivot shaft for rotating a connecting member, said pivot shaft being mounted to each of said opposing side walls of said head, said pivot shaft being orientated perpendicularly to said longitudinal axis of said head, said pivot shaft being located approximately adjacent to said front wall and said top wall;

a connecting member for connecting a driving plate and a striking hammer to said pivot shaft, said connecting member being rotatably coupled to said pivot shaft, said connecting member having a longitudinal axis generally perpendicular to said connecting member, wherein said pivot shaft is generally located at a longitudinal midpoint of said connecting member, said connecting member having a first end and a second end, wherein said first end is substantially adjacent to said front wall of said head;

a striking hammer for striking a surface when said head is moved toward said surface, said striking hammer being rotatably coupled to said first end of said connecting member, said striking hammer extending away from said connecting member toward said bottom wall, said striking hammer being generally rectangular and generally extending from one of said opposing walls to another one of said opposing walls such that said striking hammer has a longitudinal axis generally perpendicular to said longitudinal axis of said housing, said striking hammer being guided by two spaced walls extending from said bottom wall toward said top wall, said striking hammer extending through a first aperture in said bottom wall, said first aperture being located between said spaced walls;

a second aperture in said bottom wall for delivery of a staple, said second aperture being generally between said first aperture and said back wall;

a driving plate for driving staples into said surface through said second aperture, said driving plate being coupled to said second end of said coupling member, said driving plate extending from said coupling member toward said bottom wall;

a first staple guide wall, wherein said first staple guide wall is located adjacent to said second aperture such that said second aperture is between said first staple guide wall and said bore in said back wall, said first staple guide wall being mounted on said bottom wall and extending toward said top wall generally perpendicular to said longitudinal axis of said housing;

a second staple guide wall, said second staple guide wall being oriented generally perpendicular to said first staple guide wall, said second staple guide wall being fixedly mounted to each of said opposing walls of said head, said second staple guide wall extending between said bore in said back wall of said head and said first staple guide wall, a first end of said second staple guide wall being substantially adjacent to said first staple guide wall and defining a space therebetween adapted for receiving said driving plate, said second staple guide wall being spaced a distance from said bottom wall of said head approximately equal to a height of a staple;

a recoil spring for pulling said second end of said connecting member toward said top wall of said head, said recoil spring being coupled to said second end of said connecting member and an interior surface of said top wall, said recoil spring urging said second end of said connecting member toward said top wall such that said driving plate has an end situated in said space between said first and said second staple guides to define a resting position of said driving hammer;

wherein said recoil spring biases said first end of said connecting member towards the bottom wall of the head such that the striking hammer extends to an exterior of said head through said first aperture to further define said resting position;

wherein an execution position is defined by said end of said striking hammer being located substantially adjacent to said first aperture, said second end of said connecting member being adapted to drive said end of said driving plate to a point substantially adjacent to an exterior surface of said bottom wall;

said handle being a substantially cylindrical cartridge housing for holding a cartridge, said housing having a proximal end and a distal end, said proximal end of said housing having a lip thereon adapted for coupling to said shoulder of said head, said proximal end of said housing being rotatably coupled to said head, said distal end of said housing having an interior surface having threads thereon adapted to receive a cap, said distal end of said housing having an exterior surface having padding thereon;

a cap for securing a cartridge in said housing, said cap being adapted to fit in said distal end of said housing, said cap having a top portion, a middle portion and an end portion, wherein a surface of said top portion of said cap is knurled, wherein a surface of said middle portion of said cap has threads thereon adapted for coupling to said threads in said housing, wherein said end portion of said cap extends into an interior of said housing when said cap is screwed into said housing;

a cartridge for holding a plurality of rows of staples, said cartridge having a proximal end and a distal end, said cartridge being generally cylindrical, said cartridge having seven wells therein, all of said wells extending along a longitudinal length of said cartridge between said proximal end of said cartridge and a compartment within said cartridge adjacent to said distal end of said cartridge, a first, second, third, fourth, fifth and sixth of said wells each having a U-shape in a plane transverse to the longitudinal length of said cartridge, each of said U-shaped wells being adapted for receiving a row of staples such that each of said U-shaped wells has a substantially linear top portion and two side portions extending away from said top portion, said side portions being oriented substantially perpendicularly to said top portion, each of said sides of said U-shaped wells extending toward an outer surface of said cartridge, said seventh well being generally circular and extending through said cartridge along a generally longitudinal central axis of said cartridge;

a retaining disc for retaining staples in said cartridge, said retaining disc being adjacent to said proximal end of said cartridge, said retaining disc being generally circular, said retaining disc having two diametrically opposing peripheral apertures therein, wherein each of said apertures extends into said retaining disc from and edge of said retaining disc, a first of said apertures being V-shaped such that a pointed portion of said first aperture is directed toward a center point of said retaining disc, a second of said apertures being generally rectangular, said second aperture being adapted to allow exposure of only one of said U-shaped wells in said cartridge;

a shaft for rotatably coupling said retaining disc to said cartridge, said shaft being connected to a central location on said retaining disc, said shaft extending through said seventh well in said cartridge between said distal end and said proximal end of said cartridge, said shaft having a distal end extending out of said seventh well, wherein said distal end of said shaft has a knob thereon for holding said retaining disc adjacent to said proximal end of said cartridge, said knob being disc shaped and having a diameter greater than a diameter of said seventh well of said cartridge;

a compartment within said distal end of said cartridge for holding springs to urge staples toward said proximal end of said cartridge, said compartment having at least one spring for every U-shaped well in said cartridge, said springs having a first end affixed to said distal end of said cartridge, said springs having a second end having a pressure plate affixed thereto for pushing staples through said U-shaped wells;

wherein said cartridge is placed in said housing such that said retaining disc is adjacent to said back wall of said head, said back wall of said head having a pin extending therefrom for insertion into said V-shaped aperture in said retaining disc;

wherein said cap is placed on said cartridge such that said end of said cap is biased against said distal end of said cartridge; and wherein said cartridge is turned such that said second aperture exposes one of said first through sixth wells, said springs urging the staples through said second aperture of said disc and into said head adjacent to said first staple guide wall in said head.

8. A staple hammer for driving staples into a surface, said staple hammer comprising:

a head and a handle;

said head being for holding a staple driving mechanism, said head being hollow, said head having a front wall, a back wall, a top wall, a bottom wall and a pair of opposing side walls, wherein said back wall of said head having a bore therein being adapted to couple to said handle, said staple driving mechanism being generally adjacent to said front wall of said head;

said handle having a proximal end and a distal end, said proximal end of said handle being coupled to said bore in said back wall of said housing;

a cartridge for holding a plurality of rows of staples, said cartridge being adapted to be removably placed within said staple hammer between said distal end of said hammer and said driving mechanism, wherein at least one spring is located within said handle, said spring being adapted to urge the rows of staples toward said staple driving mechanism;

a pivot shaft for rotating a connecting member, said pivot shaft being mounted to each of said opposing side walls of said head, said pivot shaft being orientated perpendicularly to a longitudinal axis of said head, said longitudinal axis defined by a line extending from said front wall of said head to said back wall of said head, said pivot shaft being located approximately adjacent to said front wall and said top wall;

a connecting member for connecting a driving plate and a striking hammer to said pivot shaft, said connecting member being rotatably coupled to said pivot shaft, said connecting member having a longitudinal axis generally perpendicular to said connecting member, wherein said pivot shaft is generally located at a longitudinal midpoint of said connecting member, said connecting member having a first end and a second end, wherein said first end is substantially adjacent to said front wall of said head;

a striking hammer for striking a surface when said head is moved toward said surface, said striking hammer being rotatably coupled to said first end of said connecting member, said striking hammer extending away from said connecting member toward said bottom wall, said striking hammer extending through a first aperture in said bottom wall;

a second aperture in said bottom wall for delivery of a staple, said second aperture being generally between said first aperture and said back wall;

a driving plate for driving staples into said surface through said second aperture, said driving plate being coupled to said second end of said coupling member, said driving plate extending from said coupling member toward said bottom wall; and a recoil spring for pulling said second end of said connecting member toward said top wall of said head.

9. The staple hammer for driving staples into a surface as in claim 8, further comprising a first staple guide wall, wherein said first staple guide wall is located adjacent to said second aperture such that said aperture is between said first staple guide wall and said bore in said back wall.

10. The staple hammer for driving staples into a surface as in claim 8, additionally comprising a cartridge for holding a plurality of rows of staples, and wherein said handle forms a substantially hollow cartridge housing for holding said cartridge, said housing having a proximal end and a distal end, said proximal end of said housing being rotatably coupled to said head, a cap for securing a cartridge in said housing, said cap being adapted to fit in said distal end of said housing, said cartridge having a proximal end and a distal end, said cartridge having a shape generally identical a shape of said housing, said cartridge having a plurality of wells therein, all of said wells extending along a longitudinal length of said cartridge between said proximal end of said cartridge and a compartment within said cartridge adjacent to said distal end of said cartridge, said wells each having a U-shape in a plane transverse to the longitudinal length of said cartridge, each of said U-shaped wells being adapted for receiving a row of staples such that each of said U-shaped wells has a substantially linear top portion and two side portions extending away from said top portion, said side portions being oriented substantially perpendicularly to said top portion, each of said sides of said U-shaped wells extending toward an outer surface of said cartridge, and a compartment within said distal end of said cartridge for holding springs to urge staples toward said proximal end of said cartridge.

* * * * *